US010737895B2

(12) United States Patent
Heller et al.

(10) Patent No.: US 10,737,895 B2
(45) Date of Patent: Aug. 11, 2020

(54) FILM TRANSPORT DEVICE FOR A PACKAGING MACHINE FOR PACKAGING WITH STRETCH FILM

(71) Applicant: Bizerba SE & Co. KG, Balingen (DE)

(72) Inventors: Franz Heller, Herrenberg (DE); Sascha Kirsch, Burladingen (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 16/398,275

(22) Filed: Apr. 30, 2019

(65) Prior Publication Data

US 2019/0389682 A1 Dec. 26, 2019

(30) Foreign Application Priority Data

Jun. 25, 2018 (EP) ..... 18 179 614

(51) Int. Cl.
*B65H 20/06* (2006.01)
*B65B 41/12* (2006.01)
*B65B 11/54* (2006.01)

(52) U.S. Cl.
CPC ..... *B65H 20/06* (2013.01); *B65B 11/54* (2013.01); *B65B 41/12* (2013.01)

(58) Field of Classification Search
CPC ..... B65H 20/06; B65H 20/08; B65B 11/54; B65B 41/12
See application file for complete search history.

(56) References Cited

FOREIGN PATENT DOCUMENTS

| | | |
|---|---|---|
| EP | 0044820 A1 | 1/1982 |
| EP | 0223215 A1 | 5/1987 |
| EP | 0284538 A1 | 9/1988 |
| EP | 3093244 B1 | 3/2018 |

*Primary Examiner* — William E Dondero
(74) *Attorney, Agent, or Firm* — Leydig, Voit & Mayer Ltd.

(57) ABSTRACT

A film transport device for transporting a stretchable film includes: at least one belt conveyor, the belt conveyor having two opposing transport belts for transporting the film and a first and a second deflection roller, each of which guides one of the transport belts in continuous circulation and is arranged at an end in a respective transport belt. An end portion of the first deflection roller projects past an associated transport belt, the first deflection roller having a first transport ring at the end portion along its periphery. An end portion of the second deflection roller projects past an associated transport belt, the second deflection roller at the end portion along its periphery having a second transport ring. A first contact surface of the first transport ring extends with mechanical friction along a circumference of the first deflection roller.

13 Claims, 6 Drawing Sheets

FILM TRANSPORT DEVICE FOR A PACKAGING MACHINE FOR PACKAGING WITH STRETCH FILM

CROSS-REFERENCE TO PRIOR APPLICATION

Priority is claimed to European Patent Application No. EP 18 179 614.5, filed on Jun. 25, 2018, the entire disclosure of which is hereby incorporated by reference herein.

FIELD

The invention relates to a film transport device for transporting a stretchable film, having at least one belt conveyor, wherein the belt conveyor has two opposing transport belts for transporting the film and a first and a second deflection roller, each of which guides one of the transport belts in continuous circulation and is arranged at the end in the respective transport belt.

BACKGROUND

EP 3 093 244 B1 discloses a packaging machine for packaging products to be packaged by means of films. The films are conveyed from a film dispensing device through a movable film guiding element to a film transport device. The film transport device has two synchronously operated belt conveyors arranged in parallel. The films are transferred from the film dispensing device into the belt conveyors of the film transport device. The transport belts pick up the film by frictional engagement. The film is transported by the belt conveyors to a position in the packaging machine in which a product to be packaged can be brought to the film and packaged in the film.

The known film transport device has two deflection rollers over which the belts run. The deflection rollers and the belts are aligned. In the radial direction, the belt thus projects past the deflection roller. The film is placed between the two belts by moving it accordingly with the carriage and the guide plate. The belts pick up the film using frictional engagement. This film transfer can cause problems when the thickness and/or quality of the film varies, which is why the arrangement is normally always set for a certain film thickness/quality.

Particularly in the case of different thicknesses of the films, problems can occur in the introduction of the films from the film transport device into the belt conveyors, especially if the frictional engagement is not present to a sufficiently high degree. The packaging machine must be calibrated to the quality and thickness of the film.

SUMMARY

In an embodiment, the present invention provides a film transport device for transporting a stretchable film, comprising: at least one belt conveyor, the belt conveyor having two opposing transport belts configured to transport the film and a first and a second deflection roller, each of which is configured to guide one of the transport belts in continuous circulation and is arranged at an end in a respective transport belt, wherein an end portion of the first deflection roller projects past an associated transport belt, the first deflection roller having a first transport ring at the end portion along its periphery, wherein an end portion of the second deflection roller projects past an associated transport belt, the second deflection roller at the end portion along its periphery having a second transport ring, and wherein a first contact surface of the first transport ring extends with mechanical friction along a circumference of the first deflection roller, a second contact surface of the second transport ring extends with mechanical friction along a circumference of the second deflection roller, and the contact surfaces abut with frictional engagement.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
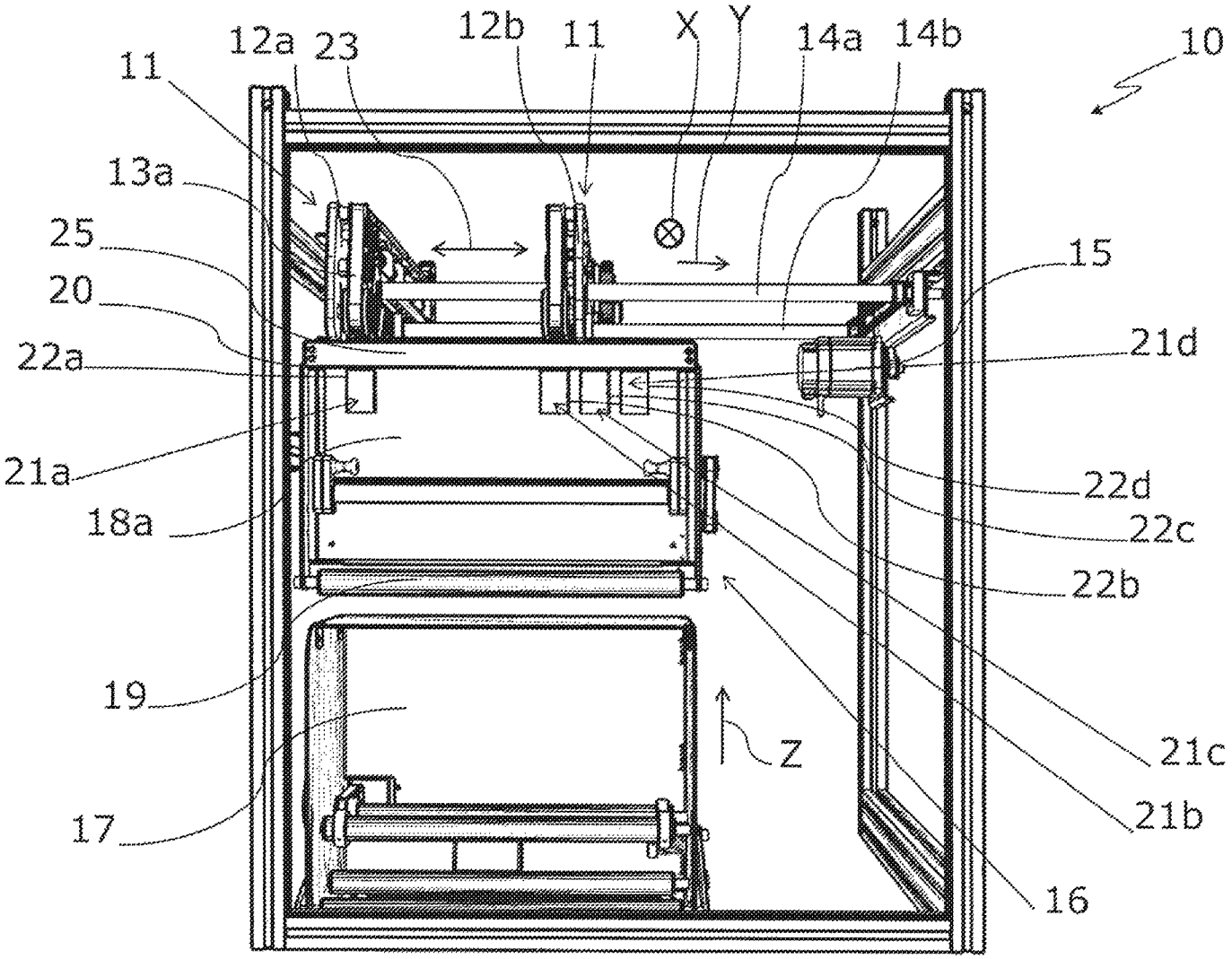
FIG. 1 is a front isometric view of a packaging machine for packaging products to be packaged.

In an embodiment, the present invention provides a film transport device for a packaging machine of the type defined at the outset, in which the introduction of the film into the film transport device takes place reliably and to a greater degree independently of the thickness and quality of the film even without changes to the film transfer device.

This object is achieved in a technically particularly simple and surprisingly effective manner by a generic packaging machine, wherein an end portion of the first deflection roller projects past the associated transport belt, that the first deflection roller has a first transport ring at the end portion along its circumference, that an end portion of the second deflection roller projects past the associated transport belt, and that the second deflection roller has a second transport ring at the end portion along its circumference, a first contact surface of the first transport ring extending along the circumference of the first deflection roller with mechanical friction, a second contact surface of the second transport ring extending with mechanical friction along the circumference of the second deflection roller, and the contact surfaces abutting with frictional engagement.

When fed to the film transport device, the films are introduced between the transport rings and come into contact with the transport rings under static friction. The transport rings can continue to convey the films until they are transferred to the transport belts. This increases the stability of the process of introducing the film into the film transport device.

The deflection rollers are designed in such a way as to have a region protruding laterally from the transport belt, which is made of an elastic material, e.g. rubber. The two deflection rollers thus form a separate frictional engagement, which advances the film somewhat, until it is reliably transferred to the belt. The rubber rings of a pair of rollers are arranged in such a way as to mutually deform each other slightly at the point of contact, thereby creating a frictional engagement.

An advantageous embodiment of the film transport device is wherein the transport rings are made of elastically deformable material, in particular rubber-elastic material. By pressing together the elastic materials of the transport rings, the frictional engagement can be effected in a space-saving manner.

A preferred further development of this embodiment is wherein the transport rings, in the condition where they have frictional engagement with one another at the contact surfaces, have a flat portion situated radially to the inside compared to the remaining surface of the transport rings. Particularly when elastic materials are used, the surfaces of the contact surfaces are pressed by the respective other contact surface in the direction of the deflection roller associated with the respective contact surface. The contact surface is flat, and the distance between the contact surface and the longitudinal axis of the deflection roller is smaller than the distance between the remaining surface of the transport ring and the longitudinal axis of the deflection roller.

A further embodiment of the film transport device is wherein at least one end portion of the first deflection roller and/or of the second deflection roller is designed as a transport ring. If the entire end portion is configured as a transport ring, a frictional engagement with the film can be effected over a particularly large surface.

A further advantageous embodiment of the invention is wherein at least the end portion of the first deflection roller and/or of the second deflection roller has a plurality of transport rings of the end portion, in particular two transport rings of the end portion. The use of multiple transport rings makes it possible to expand the area of the frictional engagement.

In particularly preferred embodiments, the transport rings are made of the same material. When the transport rings are made of the same material, a flat surface of the contact surfaces can be produced when the transport rings are in the pressed together state, thereby avoiding a deflection of the films.

A further advantageous embodiment of the film transport device is wherein a further end portion of the first deflection roller which is opposite the end portion of the first deflection roller projects past the transport belt arranged thereon. On the further end portion, the first deflection roller has a third transport ring along the circumference of the first deflection roller. Alternatively or in addition, a further end portion of the second deflection roller which is opposite the end portion of the second deflection roller projects past the transport belts arranged thereon. On the further end portion, the second deflection roller has a fourth transport ring along the circumference of the second deflection roller. In particular, the third and the fourth transport ring lie flat against one another with frictional engagement. Transport rings with contact surfaces are provided on both sides of each deflection roller. This provides frictional engagements for the film on both sides of the deflection rollers so as to enhance the reliability of the process for introducing film into the film transport device.

In a further embodiment, at least one deflection roller has a gear wheel for the drive by means of a gear drive unit, wherein a washer can be arranged in particular between the transport ring of the deflection roller and the gear wheel. Such a gear wheel allows the deflection roller to be driven in a particularly simple manner.

A further embodiment of the invention provides that the transport rings are fastened to the associated deflection rollers by means of bolts and/or screws. As a result, the transport rings can be fastened to the associated deflection rollers in a simple manner.

A preferred embodiment is wherein the deflection rollers each have a layered structure. A first layer comprises a gear wheel with a ball bearing. A second layer comprises a first washer arranged on the gear wheel. A third layer comprises a transport ring, in particular a rubber ring, which is arranged on the first washer. A fourth layer comprises a second washer, which is arranged on the transport ring. The layers are firmly connected to one another by means of screws. The transport rings before are protected and cushioned by the washers from the other parts of the deflection roller.

In a further development of this embodiment, the screws are designed as threaded bolts with a thread-free section. Threaded bolts can be introduced particularly easily into the associated openings.

A further improvement of this development can be achieved by the layer structure having through-holes for insertion of the threaded bolts, which are fastened on the other side by counter nuts. This makes it possible to fasten all layers to each other.

The scope of the present invention also includes a packaging machine for packaging products to be packaged by means of a stretchable film that has a film transport device according to the invention. Such a modified packaging machine according to the invention is distinguished by a high degree of process reliability when a film is introduced into the film transport device.

FIG. 1 shows an isometric front view of a packaging machine 10 for packaging products to be packaged by means of a stretchable film. The packaging machine has a film transport device 11 for supplying film to a product to be packaged. A first belt conveyor 12*a* and a second belt conveyor 12*b* for transporting the sheet form components of the film transport device 11. The first and second belt conveyors 12*a*, 12*b* each have first and second transport belts 13*a*, 13*b* (see FIG. 2). The transport belts 13*a*, 13*b* are synchronously driven in a predetermined film transport direction X, predetermined by the film transport device 11 (in FIG. 1 into the paper level, represented by a cross) and arranged adjacent to each other. The second belt conveyor 12*b* is movable in a direction Y perpendicular to the film transport direction X by spindles 14*a*, 14*b* and a spindle motor 15. With a film guiding element 16 of the packaging machine 10 movable in the vertical direction Z, the film can be introduced into the film transport device 11 from a film dispensing device 17. The term "vertical" relates in particular to the direction parallel to gravitational force. The film dispensing device 17 is formed below the film guiding element 16 and the film transport device 11 above the film guiding element 16. The film guiding element 16 has a first guide plate 18*a* and a second guide plate. The guide plates 18*a*, 18*b* are vertically aligned. Above a deflecting roller 19 of the film guiding element 16 at the lower end of the film guiding element 16, the film is introducible between the guide plates 18*a*, 18*b*.

A first recess 21*a* and a second, third, and fourth recess 21*b*, 21*c*, 21*d* are formed in an upper edge 20 of the guide plate 18*a* toward the belt conveyors 12*a*, 12*b* in vertical direction Z. The film guiding element 16 is movable in the vertical direction Z. As a result, the guide plate 18*a* is movable in height relative to the belt conveyors. The border 22*a* of the first recess surrounds the first belt conveyor 12*a*. Depending on the position of the movable second belt conveyor 12*b*, the borders 22*b*, 22*c*, 22*d* of the second, third, or fourth recess 21*b*, 21*c*, 21*d* surround the second belt conveyor 12*b*. The belt conveying means 12*a*, 12*b* are thereby inserted into the recesses 21*a*-21*d*. The selection between the second, third, or fourth recess 21*b*-21*d* is such that the distance 23 of the belt conveyors 12*a*, 12*b* in the recesses 21*a*-21*d* corresponds to the width of the film. This defines the zero positions of the belt conveyors with respect to the width of the film. In the context of the application, if the second recess 21*b* surrounds the second belt conveyor 12*b*, this is referred to as "first zero position." In the context of the application, if the third recess 21*c* surrounds the second belt conveyor 12*b*, this is referred to as "second zero position." Accordingly, the term "third zero position" can be used if the fourth recess 21*d* surrounds the second belt conveyor 12*b*. Further recesses may accordingly define further zero positions.

A film cutting device 25 is arranged in the vertical direction below the belt conveyors. The film is transported by the belt conveyors 12*a*, 12*b* until the film has a sufficient length as measured from the film cutting device 25 for the desired packaging operation. The film guiding element 16 with the guide plates 18*a*, 18*b* is then moved downward in the vertical direction to the film dispensing device 17. The guide plates 18*a*, 18*b* of the film guiding element 16 thus exit the film cutting device 25. The film cutting device 25 then cuts through the film. The cut-off film is then further transported through the belt conveyors 12*a*, 12*b* until the cut portion of the film is arranged in a position vertically above a lifting table. The lifting table will later move the product to be packaged in a vertical direction. Thus, the cut portion of the film is arranged vertically above the product to be packaged between the belt conveyors 12*a*, 12*b*. The film is stretched by a movement of the belt conveyor 12*b* in the direction Y perpendicular to the film transport direction X. A product to be packaged, for example a tray, can be brought to the film between the transport belts 13*a*, 13*b* by a packaging product transport device. Such a packaging product transport device may comprise a supply conveyor belt and a lifting table, as shown in the above-cited EP 3 093 244 B1. When the product to be packaged is brought to the film by a lifting operation, the film wraps around the product to be packaged. The film can be wrapped around the product to be packaged using folding claws. The product to be packaged can then be pushed onto a sealing plate on which the film is welded by a pusher, and lastly can be transported away by a conveyor belt, as shown in EP 3 093 244 B1.

Figure 2:
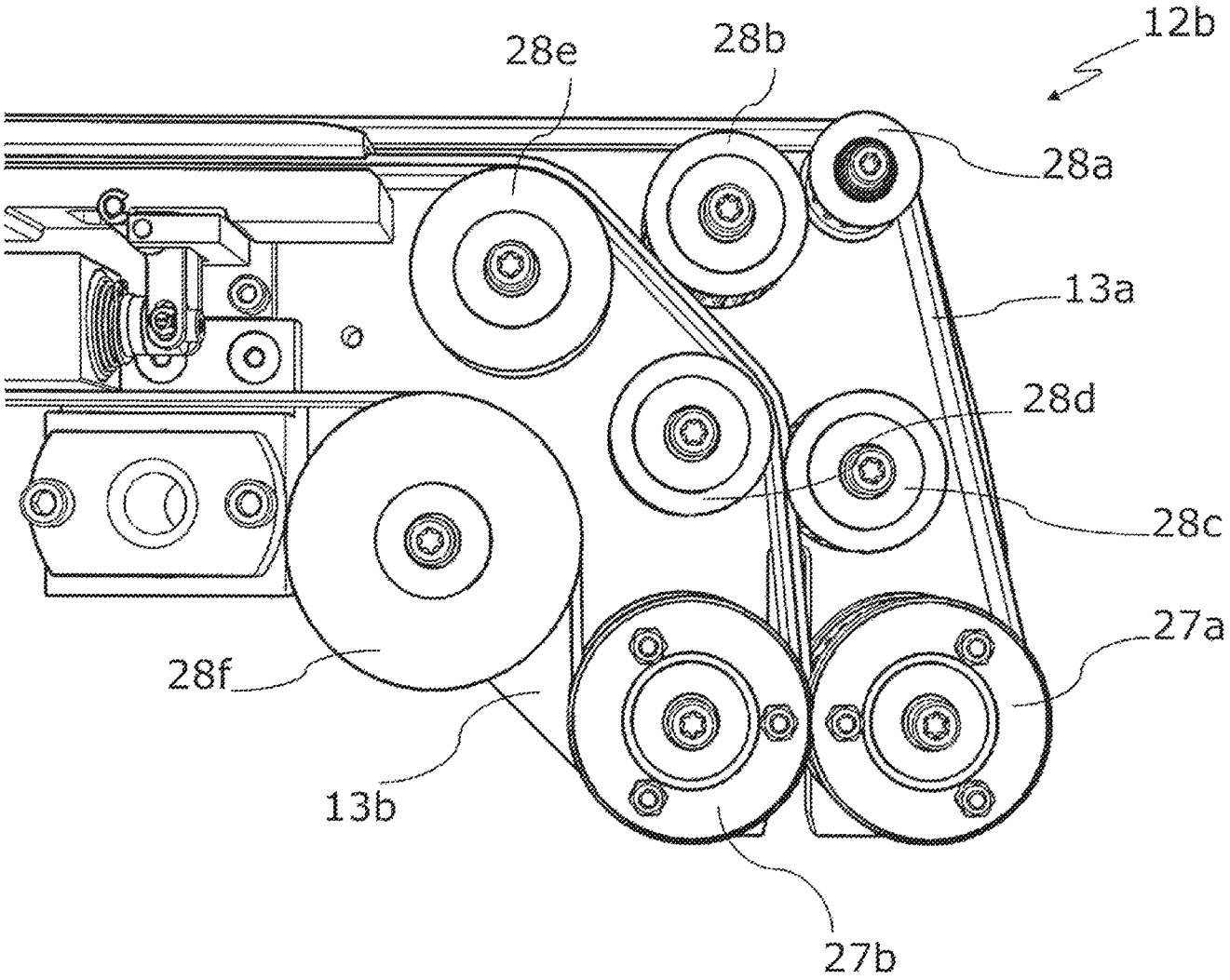
FIG. 2 is a side view of one end of a belt conveyor.

FIG. 2 shows by way of example a side view of one end of the belt conveyor 12*a*. The transport belts 13*a*, 13*b* are guided in each case by a deflection roller 27*a*, 27*b* arranged at the end in the transport belts 13*a*, 13*b*. A first, second, third, fourth, fifth, and sixth guide roller 28*a*, 28*b*, 28*c*, 28*d*, 28*e*, 28*f* for guiding the transport belt 13*a*, 13*b* are positioned downstream of the deflection rollers 27*a*, 27*b* in relation to transport direction X.

Figure 3:
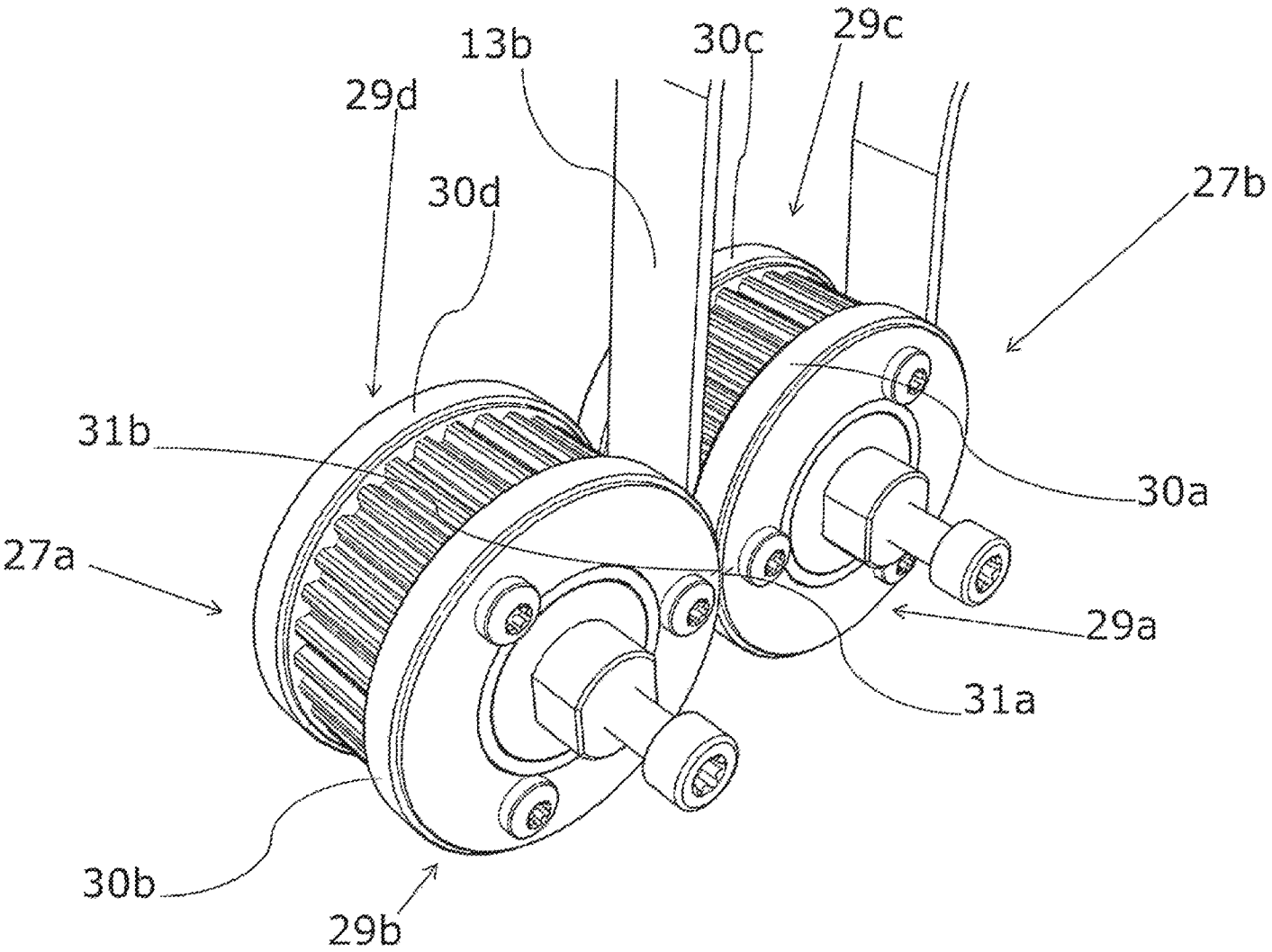
FIG. 3 is an isometric view of a first deflection roller and a second deflection roller.

FIG. 3 shows an isometric view of the first deflection roller 27*a* and of the second deflection roller 27*b* and of the transport belt 13*a* arranged on the deflection roller 27*a*. The deflection rollers 27*a*, 27*b* each have an end portion 29*a*, 29*b* and a further end portion 29*c*, 29*d* with which they project past the transport belts 13*a*, 13*b* (see FIG. 2) respectively assigned to them. A first, second, third, and fourth transport ring 30*a*, 30*b*, 30*c*, 30*d* made of elastic material, in particular rubber elastic material, are arranged on the end portions 29*a*, 29*b* and the further end portions 29*c*, 29*d*. The first transport ring 30*a* has a first contact surface 31*a* with mechanical friction and the second transport ring 30*b* a second contact surface 31*b* with mechanical friction, the contact surfaces 31*a*, 31*b* abutting with frictional engagement. Accordingly, the third transport ring 30*c* and the fourth transport ring 30*d* have a third and fourth contact surface (not shown in FIG. 3) with mechanical friction, the third and fourth contact surfaces abutting with frictional engagement. The transport rings 30*a*-30*d* may be made of the same material.

Figure 4:
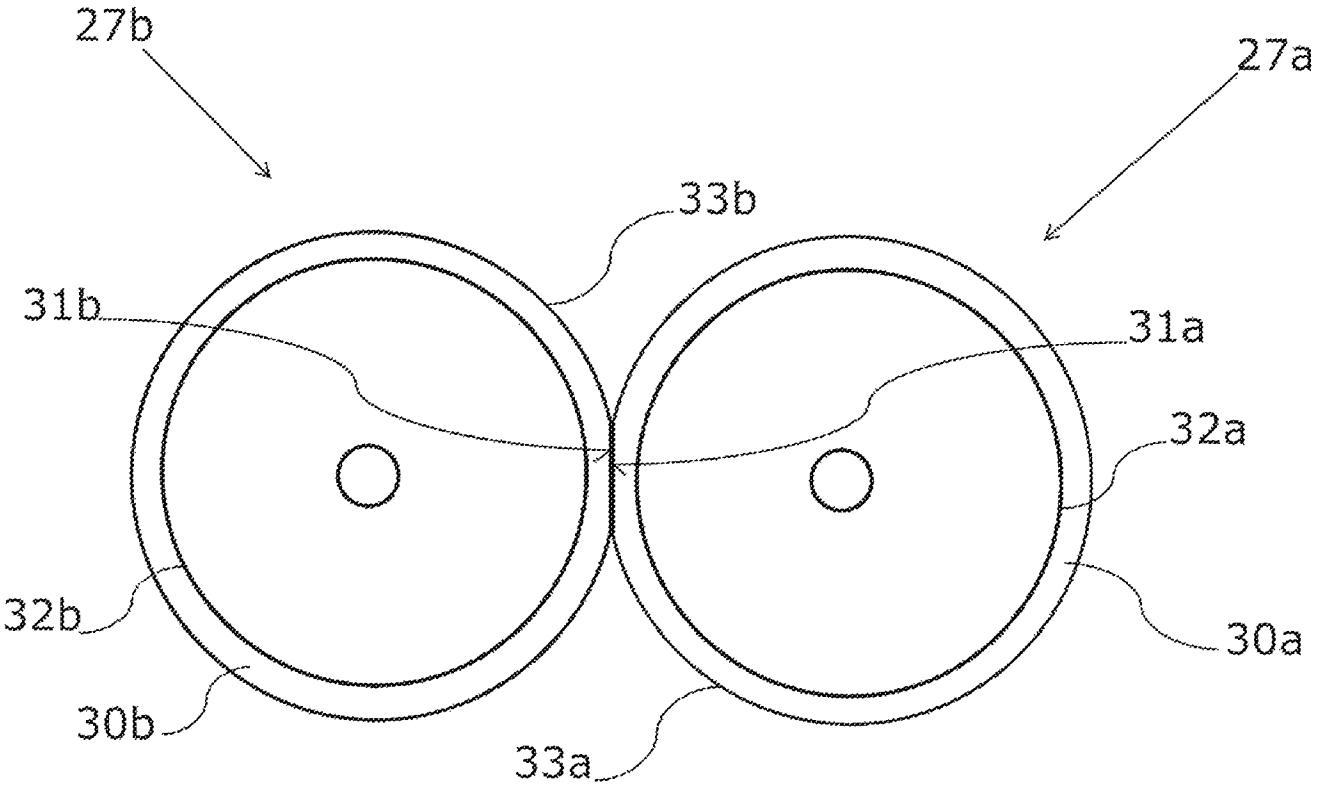
FIG. 4 is a schematic side view of the first and second deflection rollers with the first and second transport rings.

FIG. 4 shows a schematic side view of the first and second deflection roller 27*a*, 27*b* with the first and second transport ring 30*a*, 30*b*. The first contact surface 31*a* of the first transport ring 30*a* and the second contact surface 31*b* of the second transport ring 30*b* are respectively formed along the circumference 32*a*, 32*b* of the respective deflection roller 27*a*, 27*b*. In this arrangement, the transport rings 30*a*, 30*b*, in the condition in which they abut with frictional engagement on the contact surfaces 31*a*, 31*b*, have a flat portion in the radial direction compared to the remaining surface 33*a*, 33*b* of the transport rings 30*a*, 30*b*.

Figure 5:
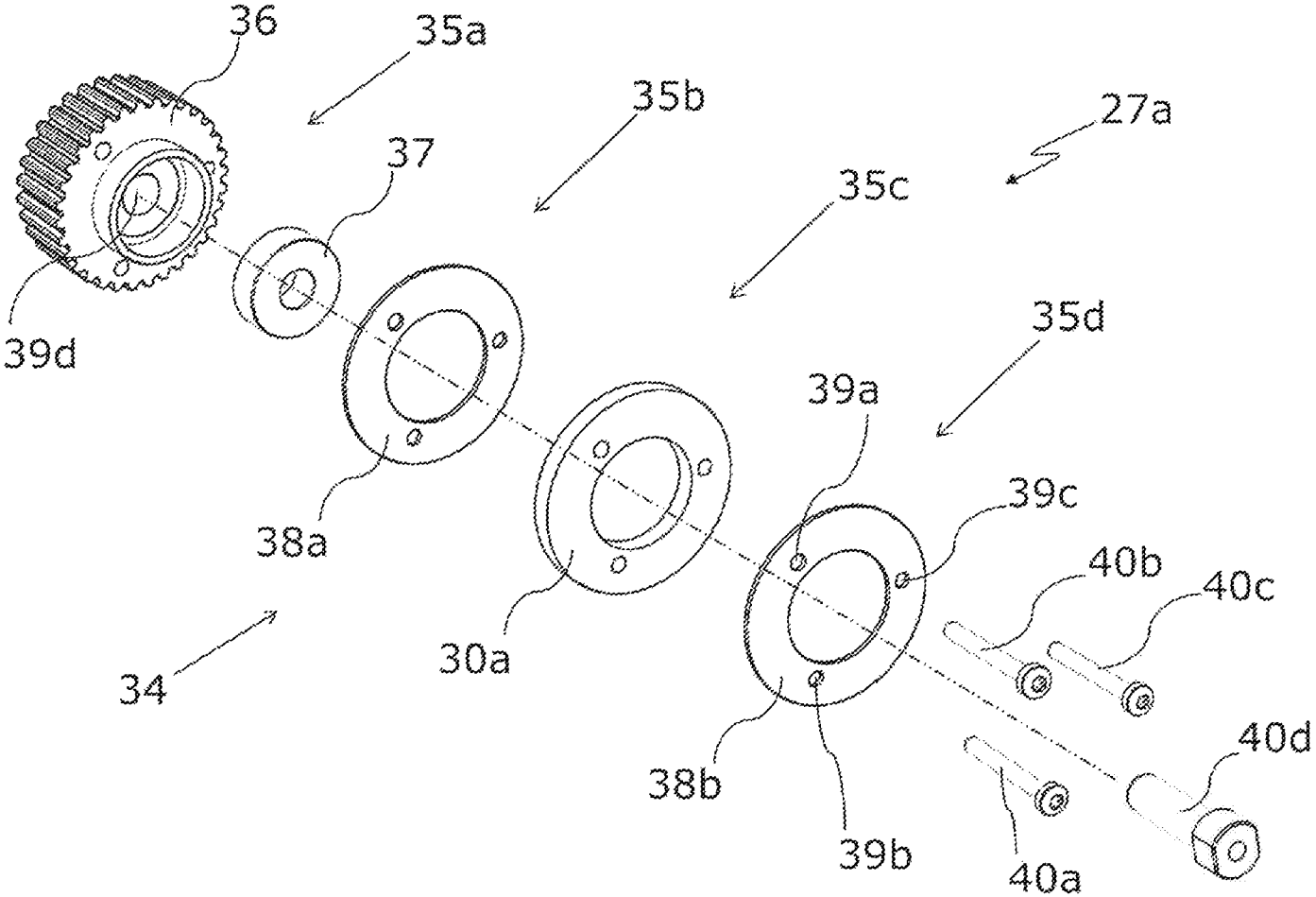
FIG. 5 is an exploded view of one of the deflection rollers.

FIG. 5 shows an exploded view of the deflection roller 27*a* by way of example. The deflection roller 27*a* has a layered structure 34 with a first layer 35*a* comprising a gear 36 and a ball bearing 37. A second layer 35*b* is arranged on this first layer 35*a* and has a first washer 38*a*. A third layer 35*c* is made up of the transport ring 30*a*, in particular in the form of a rubber ring, arranged on the first washer 38*a*. A fourth layer 35*d* comprises a second washer 38*b*, which is located on the transport ring 30*a*. The layers 35*a*-35*d* have through-holes 39*a*, 39*b*, 39*c*, 39*d*. Threaded bolts 40*a*, 40*b*, 40*c* can be passed through the holes 39*a*-39*d* to connect the layers, which are fastened on one side by counter nuts (see FIG. 6). FIG. 5 illustrates the layers arranged in front of the deflection roller 27*a*. As shown in particular in connection with FIG. 6, a corresponding layer structure is also present on the rear side of the deflection roller 27*a*. A further threaded bolt 40*d* is provided in order to fasten the deflection roller 27*a* to a retaining plate. The deflection roller 27*a* is mounted on the threaded bolt 40*d* via the ball bearing 37.

Figure 6:
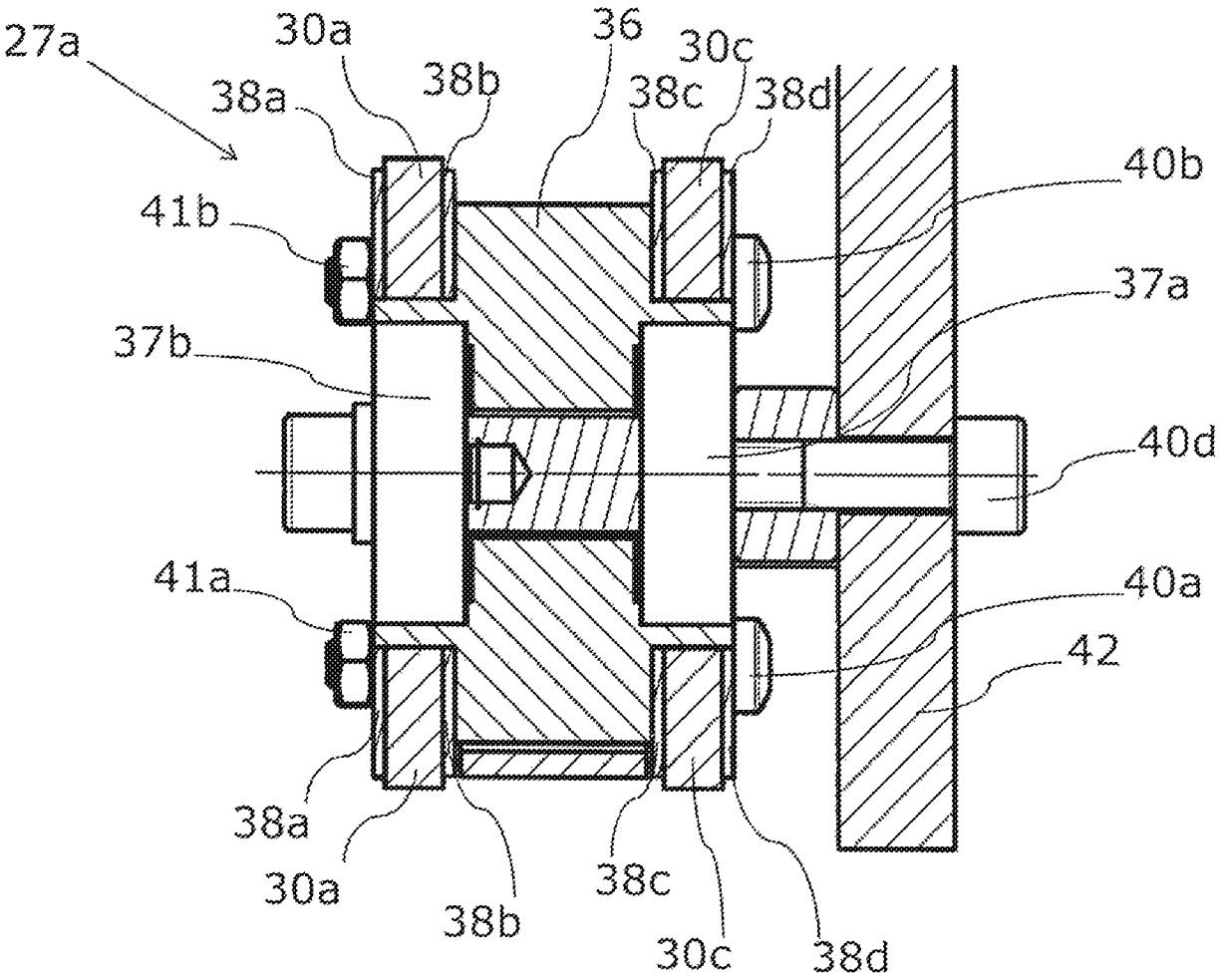
FIG. 6 is a cross section through one of the deflection rollers.

FIG. 6 shows, by way of example, a cross section through the deflection roller 27*a*. The guide roller 27*a* has the gear wheel 36, the first and third transport ring 30*a*, 30*c*, each in the form of a rubber ring, and washers 38*a*, 38*b*, 38*c*, 38*d*, which are arranged on both sides of the transport rings 30*a*, 30*c*. The deflection roller 27*a* comprises the ball bearings 37*a*, 37*b*. The gear wheel 36, the transport rings 30*a*, 30*c*, the washers 38*a*, 38*b*, 38*c*, 38*d* and the ball bearings 37*a*, 37*b* are fastened to each other by the threaded bolts (in FIG. 6: threaded bolts 40*a*, 40*b*), which are fixed to the deflection roller 27*a* via the lock nuts (in FIG. 6: 41*a*, 41*b*). The deflection roller 27*a* is fastened to a holding plate 42 with the threaded bolt 40*d*.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMBERS

10 Packaging machine
11 Film transport device
12*a* First belt conveyor
12*b* Second belt conveyor
13*a* First transport belt
13*b* Second transport belt
14*a,b* Spindles
15 Spindle motor
16 Film guiding element
17 Film dispensing device
18*a* First guide plate
18*b* Second guide plate
19 Deflection roller
20 Upper edge of the first guide plate
21*a* First recess
21*b* Second recess
21*c,d* Third and fourth recesses
22*a-d* Borders
23 Distance of the belt conveyors in the recesses
25 Film cutting device
26 Recesses of the belt conveyors
27*a,b* Deflection rollers
28*a-f* Guide rollers
29*a-d* End sections of the deflection rollers
30*a-d* Transport rings
31*a,b* Contact surfaces
32*a,b* Circumference of the deflection roller
33*a,b* Surface of the transport rings without the respective contact surface
34 Layered structure
35*a-d* Layers
36 Gear wheel
37,37*a,b* Ball bearing
38*a-d* Washers
39*a-d* Holes
40*a-d* Threaded bolt
41*a, b* Counter nuts
42 Retaining plate
X Horizontal film transport direction
Y Horizontal direction perpendicular to X
Z Vertical direction perpendicular to X and Y

What is claimed is:

1. A film transport device for transporting a stretchable film, comprising:

at least one belt conveyor, the belt conveyor having two opposing transport belts configured to transport the film and a first and a second deflection roller, each of which is configured to guide one of the transport belts in continuous circulation and is arranged at an end in a respective transport belt, wherein an end portion of the first deflection roller projects past an associated transport belt, the first deflection roller having a first transport ring at the end portion along its periphery, wherein an end portion of the second deflection roller projects past an associated transport belt, the second deflection roller at the end portion along its periphery having a second transport ring, and wherein a first contact surface of the first transport ring extends with mechanical friction along a circumference of the first deflection roller, a second contact surface of the second transport ring extends with mechanical friction along a circumference of the second deflection roller, and the contact surfaces abut with frictional engagement.

2. The film transport device according to claim 1, wherein the transport rings comprise elastically deformable material comprising a rubber-elastic material.

3. The film transport device according to claim 2, wherein the transport rings, in a condition where they have frictional engagement with one another at the contact surfaces, have a flat portion situated radially to an inside compared to a remaining surface of the transport rings.

4. The film transport device according to claim 1, wherein at least one end portion of the first deflection roller and/or the second deflection roller comprises a transport ring.

5. The film transport device according to claim 1, wherein at least the end portion of the first deflection roller and/or the second deflection roller has a plurality of transport rings of the end portion, the plurality of transport rings comprising two transport rings of the end portion.

6. The film transport device according to claim 1, wherein the transport rings are comprised of a same material.

7. The film transport device according to claim 1, wherein a further end portion of the first deflection roller that is opposite the end portion of the first deflection roller projects past the transport belt arranged thereon, and has a third transport ring at an other end portion along a circumference of the first deflection roller, and/or wherein a further end portion of the second deflection roller that is opposite the end portion of the second deflection roller projects past the transport belt arranged thereon and has a fourth transport ring, at an other end portion, that projects along a circumference of the second deflection roller, the third and fourth transport rings abutting flat with frictional engagement.

8. The film transport device according to claim 1, wherein at least one deflection roller has a gear wheel for a drive by a gear drive unit, a washer being arranged between the transport ring of the deflection roller and the gear wheel.

9. The film transport device according to claim 1, wherein the transport rings are fastened to associated deflection rollers by bolts and/or screws.

10. The film transport device according to claim 1, wherein the deflection rollers each have a layered structure, a first layer comprising a gear wheel with a ball bearing, a second layer comprising a first washer arranged on the gear, a third layer comprising a transport ring comprising a rubber ring, arranged on the first washer, a fourth layer comprising a second washer which is arranged on the transport ring, and the layers being secured to each other by screws.

11. The film transport device according to claim 10, wherein the screws comprise bolts having an unthreaded section.

12. The film transport device according to claim 11, wherein the layer structure has through-holes for insertion of the bolts which are fastened on an other side by counter nuts.

13. A packaging machine for packaging products to be packaged by a stretchable film, comprising:

the film transport device according to claim 1.

* * * * *